United States Patent [19]

Cheek et al.

[11] Patent Number: 4,802,610

[45] Date of Patent: Feb. 7, 1989

[54] POUR SPOUT

[75] Inventors: Gary C. Cheek, Fountain Inn; Andy Rice, Greenville, both of S.C.

[73] Assignee: The Dow Chemical Company, Midland, Mich.

[21] Appl. No.: 196,831

[22] Filed: May 16, 1988

Related U.S. Application Data

[63] Continuation of Ser. No. 338, Jan. 5, 1987, abandoned.

[51] Int. Cl.[4] ..... B67D 3/00

[52] U.S. Cl. ..... 222/481.5; 222/484; 222/522; 222/523; 222/532; 222/559; 222/569; 137/625.18

[58] Field of Search ..... 222/482, 532

[56] References Cited

U.S. PATENT DOCUMENTS

| | | | |
|---|---|---|---|
| 1,054,146 | 2/1913 | Smirle | 137/588 X |
| 1,288,356 | 12/1918 | Woods | 137/625.18 X |
| 2,645,401 | 7/1953 | Kerr | 222/479 X |
| 2,790,582 | 4/1957 | Halpern | 222/484 X |
| 2,812,113 | 11/1957 | Beall, Jr. | 222/479 X |
| 2,829,807 | 4/1958 | Kischenbaum | 222/484 X |
| 2,901,153 | 8/1959 | Collins | 222/525 |
| 3,207,190 | 9/1965 | Silberies et al. | 222/484 X |
| 3,262,613 | 7/1966 | Miller | 222/522 |
| 3,294,294 | 12/1966 | Amburgey | 222/525 |
| 3,399,811 | 9/1968 | Miller | 222/484 X |
| 3,439,843 | 4/1969 | Corsette | 222/568 X |
| 3,752,369 | 8/1973 | Robert | 222/522 X |
| 4,408,700 | 10/1983 | Fillmore et al. | 222/522 X |

*Primary Examiner*—Joseph J. Rolla
*Assistant Examiner*—Gregory L. Huson

[57] ABSTRACT

This invention provides an improved manually operable pour spout for use with a container of liquid, which is accomplished by a manually operable pour spout which is engageable with an opening of a container for dispensing liquid from the container and which has a valve body portion which acts as a sleeve about a conduit having a pouring orifice therein and which provides both opening of the spout and of a vent therein when in a up position and for the closing of both when in a down position.

5 Claims, 2 Drawing Sheets

FIG. 2
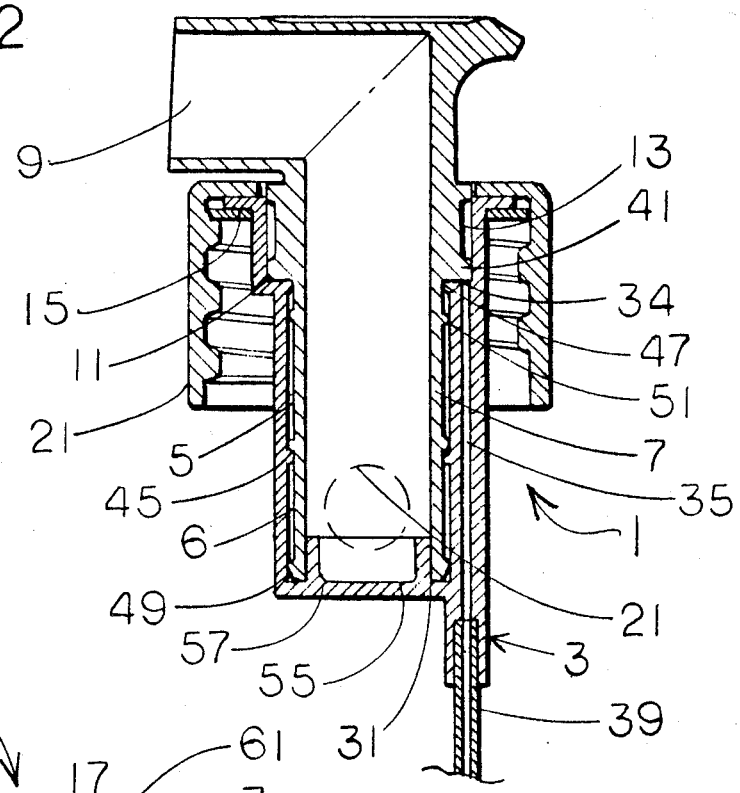
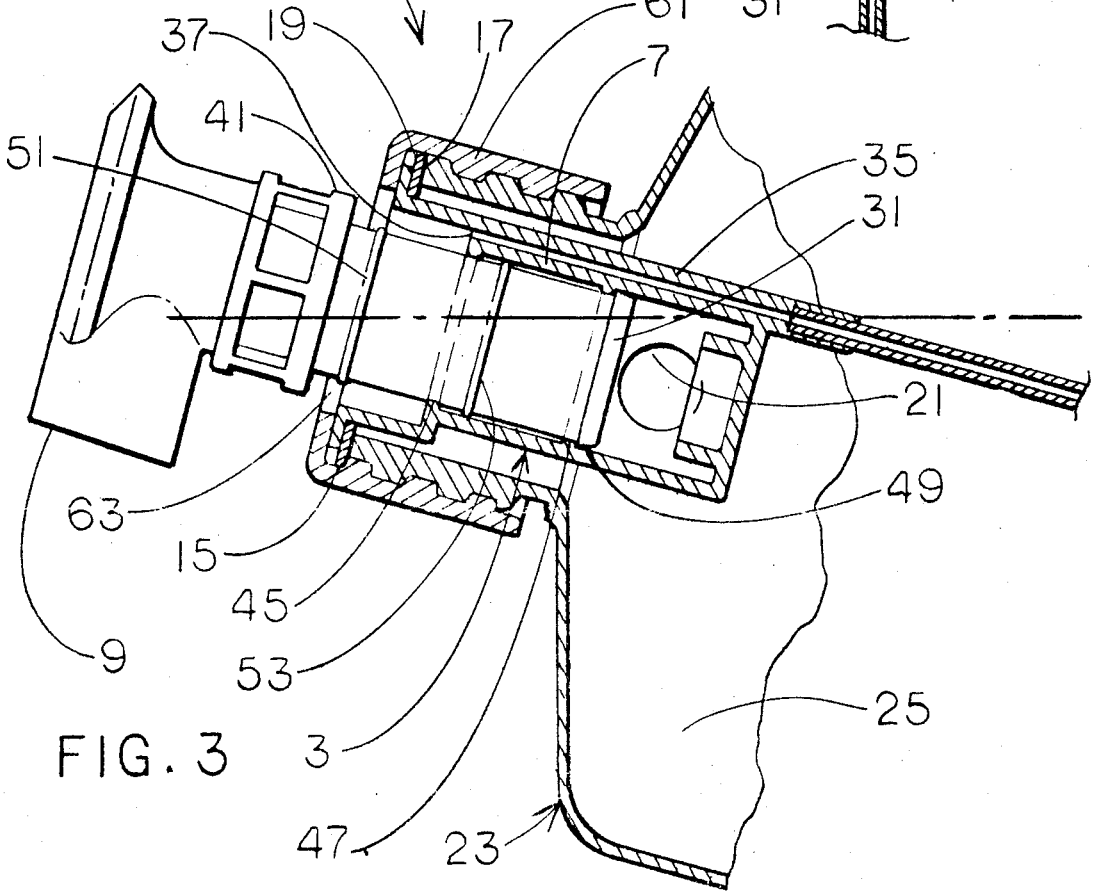
FIG. 3

POUR SPOUT

This application is a continuation of application Ser. No. 000,338 filed 01/05/87 and now abandoned.

BACKGROUND OF THE INVENTION

This invention relates generally to the art of closures and more particularly to a novel pouring spout for use on a container of liquid.

Various prior art devices exist for aid in dispensing liquids. Most such devices have been adapted specifically to assist in the dispensing of liquors while others are of a general purpose nature. Such pouring devices are disclosed in U.S. Pat. Nos. 2,790,582; 3,372,846; 999,602; and 2,812,113. U.S. Pat. No. 3,305,145 discloses a pill dispensing device which is slidably operable for opening and closing a pill container.

While such devices are operable for their intended purpose, there is a continuing need for improvements, particularly in the art of dispensing, wherein a large supply of a liquid is maintained for the purpose of replenishing the supply of such liquids in smaller more manageable containers or dispensers for such liquids. An example of which is a supply of detergent or cleaner which is maintained to replenish a manual spray container.

SUMMARY OF THE INVENTION

It is thus an object of this invention to provide an improved manually operable pour spout for use with a container of liquid.

It is a further object of this invention to provide such a pour spout which is useful for transferring liquids from a large reservoir container to a small hand held container.

It is a further and more particular object of this invention to provide such a pour spout which is openable and closable without having to remove parts thereof.

It is a further and yet more particular object of this invention to provide such a pour spout which is self-venting so as to provide an even flow of liquid through the spout.

These as well as other objects are accomplished by a manually operable pour spout which is engageable with an opening of a container for dispensing liquid from the container and which has a valve body portion which acts as a sleeve about a conduit having a pouring orifice therein and which provides both opening of the spout and of a vent therein when in an up position and for the closing of both when in a down position.

BRIEF DESCRIPTION OF THE DRAWINGS

FIG. 2 is a cross sectional assembled view of the pouring spout of FIG. 1.

FIG. 3 is a cross sectional view of the spout of FIG. 2 in a pouring position within a container of liquid.

DETAILED DESCRIPTION

Figure 1:
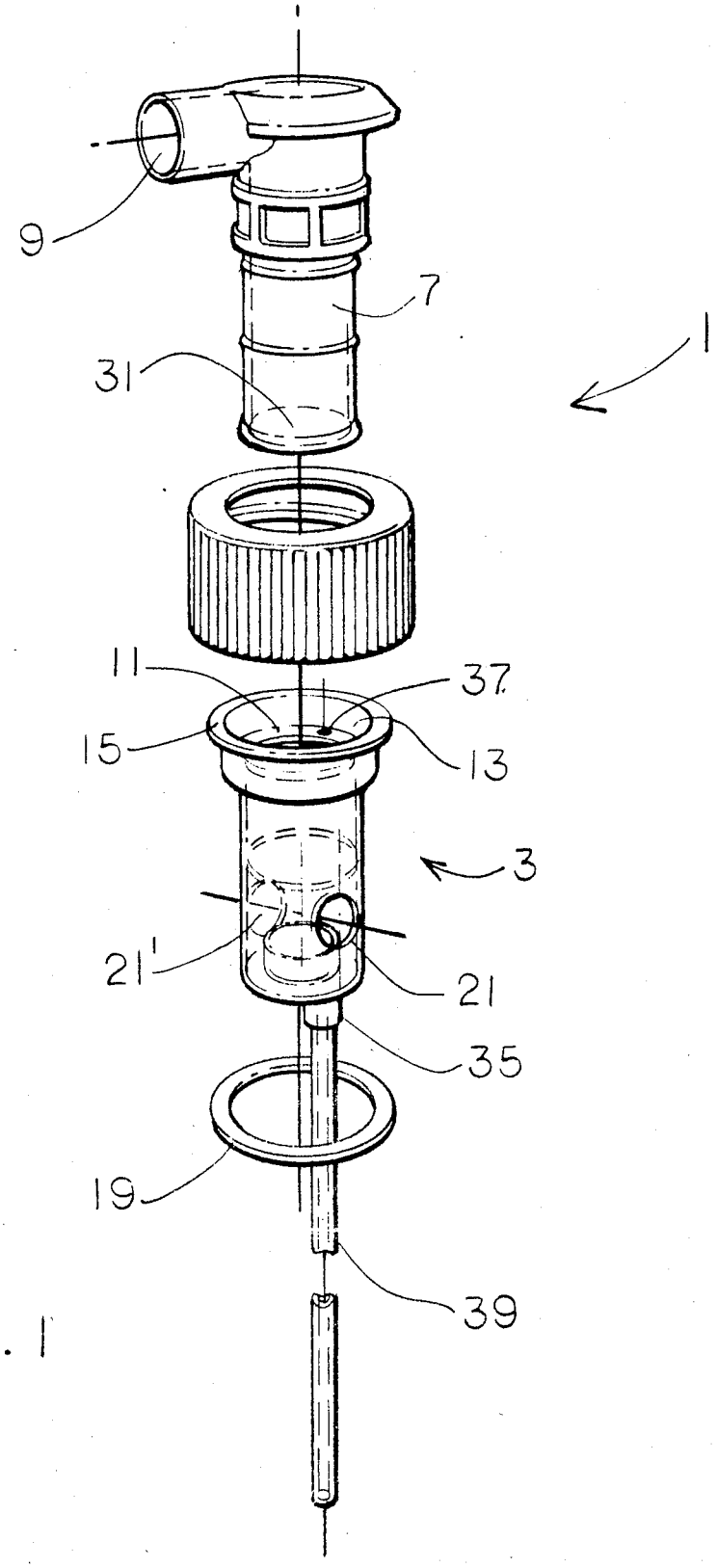
FIG. 1 is an assembly view of a pouring spout in accordance with this invention.

In accordance with this invention, it has been found that a pouring spout may be provided for use in relatively large containers which does not require removal of a separate piece for operation and which provides both opening and closing by simple movement of parts thereof. It has been further found that such a pouring nozzle may be simultaneously vented to provide uniformity of pouring and avoidance of the glug-glug frequently associated with pouring spouts. Various other advantages and features will become apparent from a reading of the following description given with reference to the various figures of drawing.

FIG. 1 of the drawing is an assembly view of the pouring spout in accordance with this invention which may be better appreciated by referring to FIG. 2, showing a cross section of the spout assembled in the down or closed position, and FIG. 3 showing the spout 1 in the up and dispensing position and as illustrated therein within a container of liquid. In the following description the various views will be referred to interchangeably, since they are all of the same device but in different positions to aid in the understanding thereof. The initial description will be given with reference to spout 1 in the down or closed position as is illustrated in FIG. 2. Spout 1 comprises a valve body portion 3 which defines a first cylindrical cavity 5 which is defined by the inner sidewalls 6 of body portion 3. Conduit means 7 are slidably received within the sidewalls 6 for movement within cavity 5. Conduit means 7 include a pouring orifice 9 for dispensing liquid when in the pouring position as illustrated in FIG. 3.

Body portion 3 expands above cylindrical cavity 5 to provide a first annular ledge 11 and above ledge 11 a second cylindrical cavity 13 which then expands to define a second annular ledge 15 which is adapted to seal with a container opening 17 (FIG. 3).

As illustrated in FIG. 3, there may be provided a thrust washer 19 and to aid in the sealing engagement of a second annular ledge 15 with container opening 17.

Body portion 3 defines through the sidewalls 6 thereof a passageway 21 which communicates with the interior of container 23 to permit flow of liquid 25 therethrough when in the pouring position as illustrated in FIG. 3. Passageway 21 may be a plurality of passageways such as illustrated at 21.

Conduit 7 has an opening 31 in the bottom portion thereof which communicates with passageway 21 when in the pouring position as illustrated in FIG. 3.

It should now be noted that conduit 7 is sealingly slidable within the sidewalls 6 by concentric bead 49 to the up position to establish such communication between passageway 21 and opening 31 and to a down position as illustrated in FIG. 2 to preclude fluid communication when in the down position of FIG. 2.

A vent 35 is provided to communicate between the body of container 23 and through first annular ledge 11 at 37. Vent 35 may be extended as by extension tube 39 to be adaptable for various depth containers.

It is seen that conduit 7 has means 41 on the exterior thereof for closing vent 35 when in the down position of FIG. 2 so as to close the opening 37 in first annular ledge 11. However, when conduit 7 is in the up position as illustrated in FIG. 3, means 41 are out of contact with opening 37, thus permitting complete venting through vent 35 and therefore by allowing free flow of liquid through orifice 9 without the conventional glug-glug associated with dispensing from large containers.

Valve body portion 3 is provided within sidewalls 6 with concentric beads 45 and 47 which co-act with concentric beads 49 and 51 on the exterior of conduit 7 to provide for limiting upward movement of conduit 7 when in the up position and for providing snap closure and opening when changing positions. Preferably bead 53 is provided to maintain centering when bead 51 is removed from first cylindrical cavity 5. In order to assure a secondary complete closure when conduit 7 is in the down or closed position of FIG. 2 and concentric bead 49 is below passageway 21, bottom 55 of body portion 3 is provided with a seal 57 concentrically inserted within opening 31 of conduit 7.

A threaded skirt 61 is provided for mating with container 23 and which has an opening 63 in the top thereof through which conduit 7 moves to its various positions and through which vent 35 communicates with the ambient environment when conduit 7 is in the up position of FIG. 3.

It is thus seen that the pour spout of this invention provides a novel device for use in dispensing and one which is operable without having to independently remove any parts for opening or closing. It is further seen that the pour spout of this invention is self-venting to provide for even pouring and elimination of the glug-glug associated with pouring from large containers. The device of this invention is well suited for dispensing from large reservoirs to smaller hand units. As many variations will become apparent from reading the above description, which is exemplary in nature, such modifications are included within the spirit and scope of this invention as defined by the following appended claims.

That which is claimed is:

1. A manually operable pour spout for engagement with an opening of a container with liquid therein for use in dispensing said liquid from said container, and in closing said container when not dispensing, comprising:

a valve body portion having side walls defining a first cylindrical cavity and a bottom wall closing said first cylindrical cavity at the bottom thereof, said valve body expanding above said first cylindrical cavity to form a first annular ledge generally concentrically encircling said cavity, said body portion extending above said annular ledge to define a second cylindrical cavity and said valve body forming a second annular ledge above said second cylindrical cavity, said second annular ledge having a top surface and a bottom surface for contacting said container opening, said valve body defining through said side walls at said first cylindrical cavity a passageway for fluid communication with the interior of said container;

a hollow cylindrical conduit slidably and sealingly received within said sidewalls to move along the axis of said body portion including a pouring orifice in the upper portion thereof and an opening in the bottom thereof which is positioned above said passageway for fluid communication with the container interior when said conduit is in an up position for dispensing and which descends below said passageway to preclude fluid communication when said conduit is in a down position for closing;

a vent tube in fluid communication with said first annular ledge;

means on the exterior of said conduit means for closing said vent tube at said first annular ledge when said conduit means is in said down position and for opening said vent when in said up position.

2. The apparatus according to claim 1 including a threaded skirt for threaded engagement with said container having an opening therethrough, through which said conduit is movable between said up and down positions.

3. The apparatus according to claim 1 including a pair of beads on said sidewalls and a pair of beads on the exterior of said conduit for limiting the upward movement of said conduit and for snap opening and closure thereof.

4. The apparatus according to claim 1 wherein said vent tube extends vertically downwardly past said bottom wall to approach the bottom of said container when installed therein.

5. The pour spout according to claim 1 further including a concentric seal located on said bottom wall of said valve body; and wherein said conduit is sealed in the opening thereof when it descends below said passageway and engages said concentric seal whereby fluid communication is precluded both by said concentric seal and by said conduit opening no longer being in fluid communication with said passageway.

* * * * *